US005260759A

United States Patent [19]

Kobayashi

[11] Patent Number: 5,260,759

[45] Date of Patent: Nov. 9, 1993

[54] IMAGE FORMING SYSTEM HAVING SHEET HOLD-DOWN DEVICE

[75] Inventor: Hiroo Kobayashi, Tokyo, Japan

[73] Assignee: Canon Kabushiki Kaisha, Tokyo, Japan

[21] Appl. No.: 15,075

[22] Filed: Feb. 8, 1993

Related U.S. Application Data

[63] Continuation of Ser. No. 737,990, Jul. 30, 1991, abandoned.

[51] Int. Cl.[5] ..... G03G 21/00

[52] U.S. Cl. ..... 355/321; 271/220

[58] Field of Search ..... 271/220, 224; 355/321, 355/322, 308, 309

[56] References Cited

U.S. PATENT DOCUMENTS

| | | | |
|---|---|---|---|
| 2,991,999 | 7/1961 | Doerner | 271/220 |
| 3,805,971 | 4/1974 | Behrens et al. | 271/220 X |
| 3,900,192 | 8/1975 | Gibson | 271/220 X |
| 4,068,839 | 1/1978 | Bullock et al. | 271/220 X |
| 4,084,809 | 4/1978 | Looney | 271/220 |
| 5,017,972 | 5/1991 | Daughton et al. | 355/321 |
| 5,033,731 | 7/1991 | Looney | 271/220 X |

FOREIGN PATENT DOCUMENTS

| | | |
|---|---|---|
| 247214 | 3/1912 | Fed. Rep. of Germany . |
| 60-55361 | 3/1985 | Japan . |
| 61-7171 | 1/1986 | Japan . |

OTHER PUBLICATIONS

Ernst, IBM Technical Disclosure Bulletin, vol. 23, No. 6, Nov. 1980.

IBM Technical Disclosure Bulletin, "Variable Size Exit Tray", vol. 18, No. 7, Dec. 1975, D. F. Colglazier, et al.

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image forming system includes a sheet ejection open tray on which ejected sheets can be collected; and a sheet hold-down device including a sheet hold-down member pivotally mounted on the sheet ejection open tray via a support shaft for pivotal movement in a direction perpendicular to a surface of the sheet ejection open tray, and a hold-down member biasing device for biasing the sheet hold-down member away from the surface of the sheet ejection open tray in opposition to a weight of the sheet hold-down member itself and for maintaining a predetermined urging force of the sheet hold-down member so long as the sheet hold-down member is within a predetermined range of its pivotal movement.

8 Claims, 4 Drawing Sheets

IMAGE FORMING SYSTEM HAVING SHEET HOLD-DOWN DEVICE

This application is a continuation of application Ser. No. 07/737,990 filed Jul. 30, 1991, now abandoned.

BACKGROUND OF THE INVENTION

1. Field of the Invention

The present invention relates to an image forming system having a sheet hold-down device, such as a copying machine, printer and the like, and more particularly it relates to an image forming system having a deep ejection tray capable of collecting a large number of sheets.

2. Related Background Art

Recently, in image forming systems such as copying machines, printers and the like, in order to save time for supplying sheets for a large number of prints, the stacking capacity for sheets to be supplied has been increased. For example, in a large-sized or middle-sized copying machine, a sheet supply deck having a large sheet stacking capacity has been used, and, even in a small-sized copying machine, a sheet supply cassette having a stacking capacity capable of supplying 500 or more sheets at a time has been used.

Pursuant to the increase in the sheet stacking capacity, the sheet collecting capacity has been increased to stack a large number of ejected sheets for copying a large number of prints by using a deeper ejection tray arranged at an upper part of the system.

If the deep ejection tray is used to increase the sheet collecting capacity, when a sheet ejected by a pair of ejector rollers is rested on the ejection tray, the distance that a trailing end of the sheet is dropped onto the ejection tray in space will be increased. Consequently, there is the discrepancy in the falling points of the sheets on the ejection tray, thereby worsening the registration of the sheets collected on the ejection tray.

Incidentally, some image forming systems are of the type that the sheets can be sorted in such a manner that they are shifted (when out of position) in groups on the ejection tray by shifting a pair of ejection rollers in the axial direction or by shifting the ejection tray in a direction perpendicular to a sheet feeding direction. Particularly, in an image forming system of this kind, in order to maintain the sorted condition, the sheets must be collected on the ejection tray with correct registration.

For this reason, in the image forming system having a deep ejection tray 2 attached to an upper part of a body frame 1 as shown in FIG. 4, there is normally provided a sheet hold-down member 5 for urging or holding down a leading end of the sheet (not shown) before a trailing end of the sheet falls on the ejection tray in order to prevent the movement of the sheet (on the ejection tray) ejected out of the system by means of a pair of ejector rollers 3.

The conventional sheet hold-down member 5 arranged at the ejection tray portion 2 of the image forming system is pivotally mounted, at its base end, on the body frame 1 via a support shaft 6 for pivotal movement in a direction (shown by the arrow) perpendicular to a surface of the tray, so that the sheet hold-down member can hold the sheet ejected on the ejection tray with a predetermined urging force by its own weight. In this case, the leading end of the sheet ejected out of the system by means of the ejector roller pair 3 is slidingly moved upwardly along the inclined surface of the tray and then is slid below a bent portion 7 formed on a free end of the hold-down member 5 so that the sheet is held down by the bent portion 7 with the predetermined force.

As mentioned above, although the sheet hold-down member holds the sheet by its own weight, if the weight of the member is too great, the leading end of the sheet cannot be slid below the bent portion 7, with the result that the sheets are not ordered on the tray, thus preventing the correct stacking of the sheets. Accordingly, the sheet hold-down member 5 is made of a thin molded plate or a fine metal wire or rod to reduce the weight thereof.

However, since the conventional sheet hold-down member 5 arranged at the ejection tray portion 2 of the image forming system is weak in construction, it is easily deformed or damaged if an operator roughly handles it, with the result that the correct or normal function of the sheet hold-down member will deteriorate. Further, since the sheet hold-down member 5 is pivoted around the support shaft 6, as it is lifted in accordance with the increase in the sheets collected on the ejection tray, the urging force of the sheet hold-down member acting on the sheet will be decreased, thus making the sheet holding function unstable.

On the other hand, in the image forming system having the deep ejection tray 2, since a large number of sheets can be collected, the operator does not often pay attention to the sheet ejecting condition in comparison with normal image forming systems, and, thus, in many cases, a sheet full load condition is left as it is. Consequently, overejected sheets sent to the ejection tray exceeding its maximum sheet collecting capacity are dropped onto a floor to become dirty or are jammed in the vicinity of the ejector roller pair 3.

SUMMARY OF THE INVENTION

The present invention aims to eliminate the above-mentioned conventional drawbacks, and an object of the present invention is to provide an image forming system having a sheet hold-down device, which can hold sheets with a constant urging force even when the amount of sheets collected onto an ejection tray is changed and which has a function for detecting a sheet full load condition.

In order to achieve the above objective, the present invention provides an image forming system having a deep ejection tray attached to an upper part of the system and capable of collecting a large number of sheets.

The present invention is characterized by a sheet hold-down device comprising a sheet hold-down member pivotally mounted, at its base end, on a sheet ejection tray via a support shaft for pivotal movement in a direction perpendicular to a surface of the tray, and a hold-down member biasing means for biasing the sheet hold-down member away from the surface of the tray in opposition to the weight of the sheet hold-down member and for maintaining an urging force of the sheet hold-down member to a constant value so long as the sheet hold-down member is within a predetermined range of its pivotal movement.

According to another aspect, the present invention is characterized by a sheet-hold down device comprising a sheet hold-down roller disposed on a sheet ejection tray, and a roller supporting member for rotatably supporting roller shafts formed on both ends of the sheet hold-down roller laterally outside of sheets collected on the sheet ejection tray and for guiding the sheet hold-down roller for up-and-down movement with respect to a surface of the tray within a predetermined range.

The sheet hold-down device may include a detection means for detecting the fact that the sheet hold-down member or the sheet hold-down roller is brought into a sheet full load position.

With the arrangements as mentioned above, the weight of the sheet hold-down member of the sheet hold-down device is relieved or lightened by a biasing force of the hold-down member biasing means. Thus, it is possible to use a sheet hold-down member having a relatively tough or rigid construction which would increase the weight of the member itself.

The biasing force of the hold-down member biasing means for biasing the sheet hold-down member is changed in accordance with the pivot angle of the sheet hold-down member so that it is decreased as the sheet hold-down member is shifted upwardly. As a result, the sheet hold-down member always has a predetermined urging force at any pivot angle so long as the member is within the predetermined range of its pivotal movement.

Further, the sheet hold-down device is constituted by the combination of the sheet hold-down roller and the roller supporting member. Thus, the sheet hold-down device has a rigid construction.

The sheet hold-down roller is shifted upwardly with being guided by the roller supporting member as a sheet collecting amount on the tray is increased, thereby hold the sheets by its own weight. As a result, the sheet hold-down roller has the predetermined urging force at any shifted position.

In addition, the detection means of the sheet hold-down device detects the fact that the sheet ejection tray is completely filled with the sheets. Accordingly, by stopping a sheet supplying operation of the image forming system or by alerting the sheet full load condition to the operator in response to a detection signal from the detection means, it is possible to avoid the overload of the sheets on the tray, thus preventing the sheets from dropping on the floor to become dirty and the jamming of the sheet in the vicinity of the ejector roller pair.

In the image forming system according to the present invention, it is possible to use a sheet hold-down device which is rigid and is not deformed or damaged and which can always hold the sheets with the constant urging force even when the sheet collecting amount on the tray is changed.

Further, since the sheet hold-down device has detection means for detecting the fact that the sheet hold-down member or the sheet hold-down roller is brought into the sheet full load position, it is possible to stop the operation of the image forming system or alert the operator to the sheet full load condition, in response to the detection signal from the detection means.

DESCRIPTION OF THE PREFERRED EMBODIMENTS

The present invention will now be explained in connection with embodiments thereof with reference to the accompanying drawings.

First of all, a first embodiment of the present invention will be explained.

Figure 1:
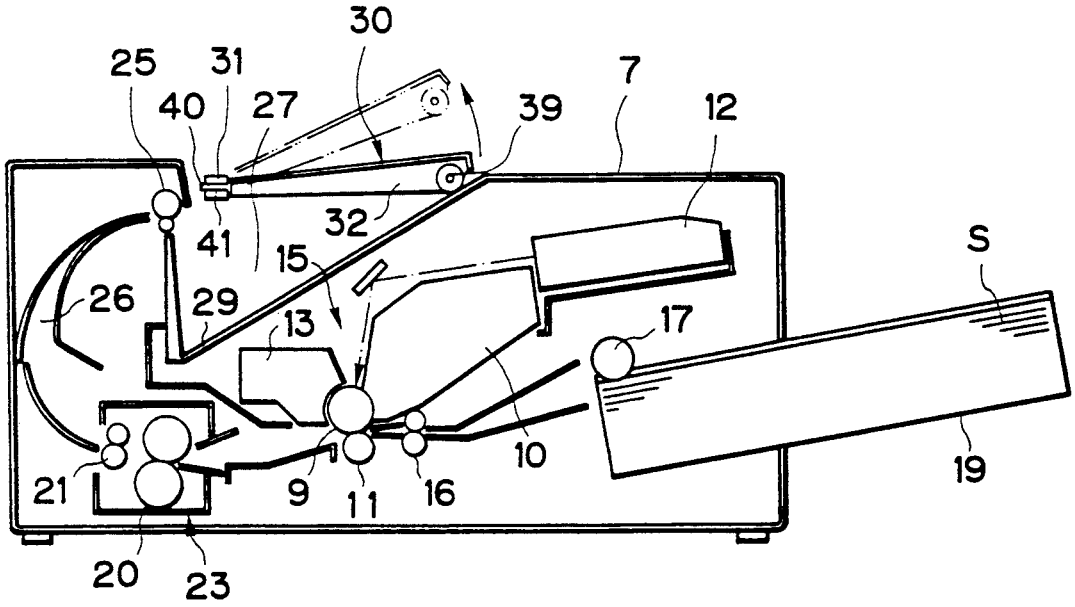
FIG. 1 is an elevational sectional view of an image forming system (laser beam printer) according to a preferred embodiment of the present invention.
Figure 2A:
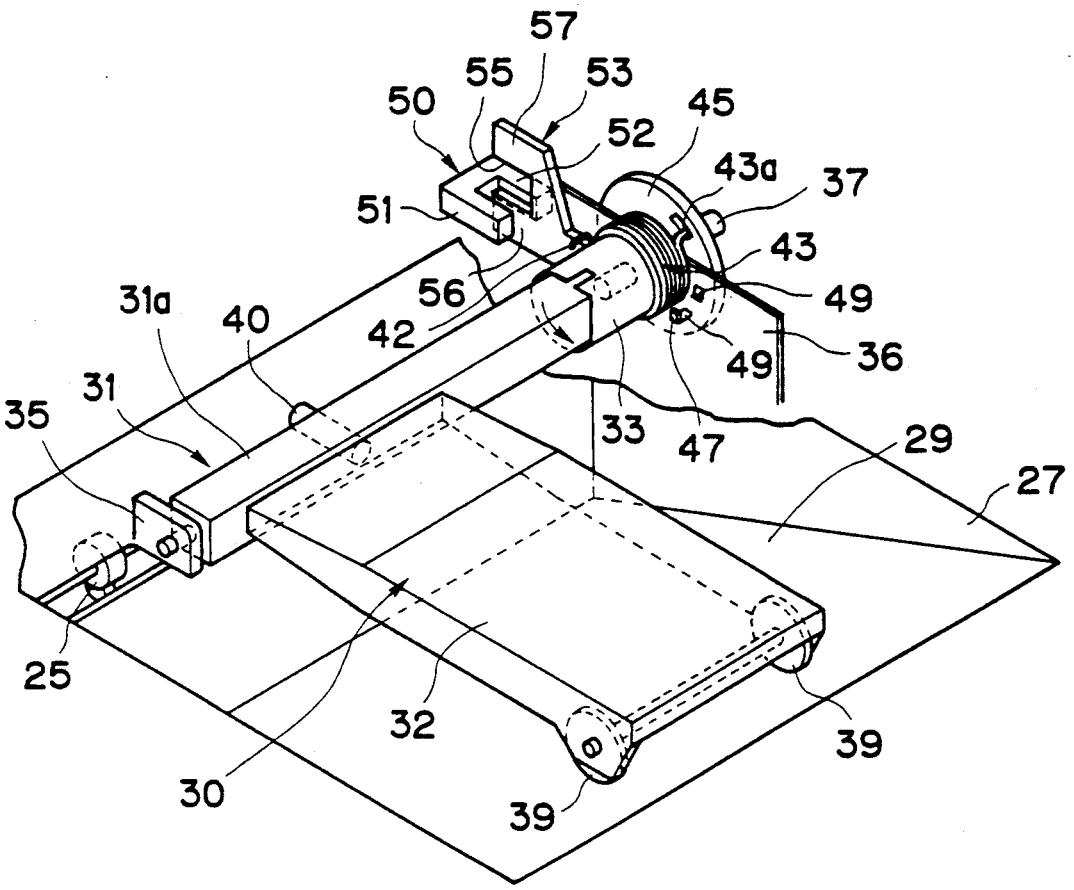
FIG. 2A is a perspective view of a main portion (inventive portion) of the image forming system.

FIG. 1 generally shows an image forming system (laser beam printer) according to a first embodiment of the present invention, and FIG. 2A shows a main portion (inventive portion) of the image forming system.

First of all, the image forming system will be briefly described with reference to FIG. 1.

At a central position within a body frame 7 of the image forming system, there is disposed an image forming means 15 comprising a photosensitive drum 9, a process cartridge 10 incorporating a primary charger, developing device (both not shown) and the like, a transfer roller 11, a laser scanner 12, and a cleaner 13. At a sheet supply side of the image forming means 15, there are disposed a pair of registration rollers 16, a sheet supply roller 17 and a sheet supply cassette 19. On the other hand, at a sheet ejecting side of the image forming means 15, there are disposed a fixing device 23 comprising a pair of fixing rollers 20 and a pair of convey rollers 21, and a pair of ejector rollers 25.

A sheet S supplied from the sheet supply cassette 19 by the sheet supply roller 17 is sent to an image forming portion (transfer roller 11) of the image forming means 15 by means of the registration roller pair 16, where an image formed on the photosensitive drum is transferred onto the sheet. Then, the transferred image is fixed onto the sheet by the fixing device 23. Thereafter, the sheet S is sent along a sheet feeding path 26 to an upper part of the body frame 7 and then is ejected out of the system by means of the ejector roller pair 25 to be collected on a deep sheet ejection tray 27. In this case, a leading end of the sheet S ejected out of the system by means of the ejector roller pair 25 is slidingly moved upwardly along an inclined surface 29 of the tray and then is held down by a sheet hold-down device 30 arranged above the ejection tray 27, with a predetermined urging force. In this condition, a trailing end of the sheet S is falling on the tray 27.

Next, the sheet hold-down device 30 arranged above the ejection tray 27 will be explained with reference to FIG. 2A.

The sheet hold-down device 30 comprises a sheet hold-down member 32 pivotally supported for pivotal movement around a support shaft 31 in a direction perpendicular to a surface of the tray, and a torsion coil spring (hold-down member biasing means) 43 for biasing the sheet hold-down member 32 away from the surface of the tray (i.e., toward an upward direction in FIG. 1) in opposition to a weight of the member itself.

The sheet hold-down member 32 is removably mounted on the support shaft 31 which is separately formed from the member. The support shaft 31 comprises a prismatic base portion 31*a* and a cylindrical drum portion 33 which are integrally connected to each other. In the support shaft 31, the base portion 31*a* is rotatably supported, at its one end, by a bearing portion 35 formed on the body frame 7, and the drum portion 33 is rotatably supported by a horizontal fixed shaft 37 provided on a side plate 37 formed on the body frame 7.

The sheet hold-down member 32 is made of molded material as a box-shape having a thick wall so that the sheet hold-down member has a rigid construction. A pair of left and right rollers 39 are rotatably mounted on a lower portion of a free end of the sheet hold-down member 32, and a connection pin 40 is protruded horizontally from a rear end of the sheet hold-down member at its central portion. The sheet hold-down member 32 is mounted on the support shaft 31 by fitting the connection pin 40 into a hole 41 (FIG. 1) formed in the base portion 31*a*. In this case, the position of the sheet hold-down member 32 is adjusted by rotating the member around the connection pin 40 in a clockwise or anti-clockwise direction so that the left and right rollers 39 correctly contact the surface of the tray.

The torsion coil spring 43 is fitted around a peripheral surface of the drum portion 33 of the support shaft 31, and a hook 42 formed on one end of the spring is locked at the drum side and a hook 43*a* formed on the other end of the spring is locked on a circular adjusting plate 45 rotatably mounted on the fixed shaft 37. An L-shaped positioning hook 47 is formed on an inner surface of the adjusting plate 45. By inserting the hook 47 into one of holes 49 formed in the side plate 36 in a circumferential direction thereof, the adjusting plate 45 can be fixed with respect to the side plate 36. By selecting the hole 49 into which the hook 47 is to be inserted, a spring force of the torsion coil spring 43 for biasing the sheet hold-down member 32 away from the tray surface is varied. Accordingly, when the adjusting plate 45 is fixedly positioned with respect to the side plate 36, the hook 47 is inserted into the hole 49 which provides the spring force in accordance with the weight of the sheet hold-down member 32 itself.

Such a torsion coil spring 43 affords a predetermined urging force to the sheet hold-down member 32 at any pivot angle of the latter when this member is within a predetermined range of its pivotal movement. The torsion coil spring 43 is so arranged that the return torsion force thereof becomes stronger when the support shaft 31 is rotated in the clockwise direction and weaker when the shaft 31 is rotated in the counter-clockwise direction. The urging force of the sheet hold-down member 32 is selected so that the leading end of the sheet S can slide in below the rollers 39 and the sheet is prevented from moving on the tray. That is to say, when the sheet hold-down member 32 is in the horizontal condition as shown in FIG. 1, since the weight $G_1$ ($mass_1 \times gravity$; where $mass_1$ is the mass of the sheet hold-down member in the direction of the gravity vector) of the sheet hold-down member acting on the rollers 39 is great, by increasing the left rotational force $P_1$ of the sheet hold-down member 32 (i.e., force for lifting this member) by means of the coil spring 43, an appropriate urging force ($G_1-P_1$) is given to the sheet hold-down member 32. On the other hand, when the sheet hold-down member 32 is in a position shown by a phantom line in FIG. 1, the weight $G_2$ $mass_2 \times gravity$; where $mass_2$ is the mass of the sheet hold-down member in the direction of the gravity vector of the sheet hold-down member acting on the rollers 39 is smaller than the weight $G_1$ because of the inclination of the sheet hold-down member. In this case, since the torsion coil spring 43 is also rotated in the counter-clockwise direction (to reduce the spring force), the left rotational force $P_2$ will be smaller than the force $P_1$. Thus, the spring force is so selected the relation $(G_2-P_2)=(G_1-P_1)$ is obtained.

On the side plate 36, there is disposed a sheet hold-down member detection sensor 50 for detecting the fact that the sheet hold-down member 32 is brought to a sheet full load position. The sheet hold-down detection sensor 50 comprises a light emitting element 51 such as a luminous diode and a light receiving element 52 such as a photo-transister so that, when the light receiving element 52 receives the light from the light emitting element 51, the sensor outputs a detection signal.

On the other hand, a shield plate 53 for activating the sheet hold-down member detection sensor 50 is arranged on the drum portion 33 of the support shaft 31. The shield plate 53 has a notched portion 55 for passing the light from the light emitting element 51, and shield portions 56, 57 for blocking the light from the light emitting element 51. When the sheet hold-down member 32 does not reach the sheet full load position, the shield portion 56 faces the light emitting element 51 of the detection sensor 50 (sensor OFF); whereas, when the sheet hold-down member 32 reaches the sheet full load position, the notched portion 55 faces the light emitting element 51 of the sensor 50 (sensor ON). Further, the sheet hold-down member 32 exceeds the sheet full load position, the shield portion 57 faces the light emitting element 51 of the sensor 50 (sensor OFF).

When the sheet hold-down member detection sensor 50 detects the fact that the sheet hold-down member 32 reached the sheet full load position, the sheet supplying operation of the image forming system is stopped, or the sheet full load condition is alerted to the operator. In this way, after the sheet full load condition, the sheet is prevented from falling on a floor or from being jammed in the vicinity of the ejector roller pair 25.

When the sheet full load condition is reached, the operator can remove the sheets collected on the ejection tray 27 after he detaches the sheet hold-down member 32 from the support shaft 31. When the sheet hold-down member 32 is detached from the support shaft 31, since the support shaft 31 is further rotated by the spring force of the torsion coil spring 43, the shield portion 57 will face the light emitting element 51 of the sheet hold-down member detection sensor 50, thus making the sensor 50 OFF condition.

In a sheet hold-down device 30 so constructed, before the sheet supplying operation is initiated, the rollers 39 of the sheet hold-down member 32 contact the inclined surface 29 of the ejection tray 27 with the predetermined urging force (condition shown by the solid line in FIG. 1). In this condition, after the predetermined treatment processes has been finished regarding the sheet S within the body frame 7 of the image forming system, the latter is ejected by means of the ejector roller pair 25 onto the ejection tray 27 disposed outside the system. When the sheet S is ejected out of the system by means of the ejector roller pair 25, the leading end of the sheet slidingly moves upwardly along the inclined surface 29 of the ejection tray 27 and then slides in below the rollers 39 of the sheet hold-down member 32 while rotating these rollers. When the leading end of the sheet reaches the predetermined position, it is held by the sheet hold-down member 32 via the rollers 39 with the predetermined urging force.

In this way, as the sheets S are ejected successively, the number of the sheets collected on the ejection tray 27 (i.e., the sheet collecting amount) is gradually increased, and accordingly, the sheet hold-down member 32 is also gradually pivoted upwardly around the support shaft 31 (condition shown by the phantom line in FIG. 1). In this case, the urging force of the sheet hold-down member 32 for urging the sheet S is always constant at any pivot angle of the sheet hold-down member. When the sheet hold-down member 32 is lifted up to the sheet full load position, the sheet hold-down member detection sensor 50 detects that fact.

When the sheet hold-down member 32 is dismounted from the support shaft 31 after the sheet full load condition is reached or the image forming system becomes a non-used condition, or when the sheet hold-down member 32 is mounted on the support shaft 31, since the sheet hold-down member 32 is made of the molded material to have the rigid construction, it is not deformed or damaged during the handling of this member.

Figure 2B:
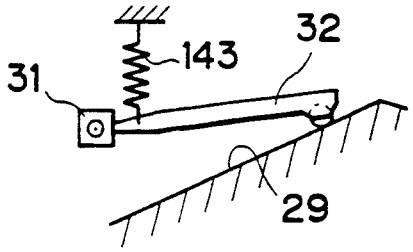
FIG. 2B is a schematic elevational view showing an alteration.

In the illustrated embodiment, while the torsion coil spring 43 was used, in place of the torsion coil spring, a tension spring 143 may be used as shown in FIG. 2B. Regarding this case, an example will be described by using concrete numerical values.

(a) When there is no sheet on the ejection tray 27, the urging force of the sheet hold-down member 32 due to its own weight was 0.254N ($mass_1 \times gravity$), and when the sheet hold-down member is in the sheet full load condition, the urging force was 0.239N ($mass_2 \times$ gravity), so that the difference in force became about 0.147N.

(b) Next, a distance between a center of rotation (shaft 31) of the sheet hold-down member 32 and an attachment position of the spring to the sheet hold-down member was 20 mm, and the spring was lengthened by 5 mm between the no sheet condition and the sheet full load condition. A spring constant K of this spring was 0.032N mm. Further, the spring force in the no, sheet condition was selected to have a value of 2.106N.

Torques generated by the spring at the center of rotation of the sheet hold-down member 32 would be as follows:

$T_1 = 2.107 \times 0.02 = 4.214 \times 10^{-2}$N.m (no sheet condition);

$T_2 = (2.107 - 0.032 \times 5) \times 0.02 = 3.894 \times 10^{-2}$N.m (sheet full load condition).

Since a length of arm of the sheet hold-down member 32 was 216 mm, the urging forces given by the spring (for urging the sheet) would be as follows:

$4.214 \times 10^{-2}/0.216 - 0.195$N (no sheet condition);

$3.894 \times 10^{-2}/0.216 - 0.180$N (sheet full load condition).

(c) Accordingly, from the above (a) and (b), the actual sheet urging forces would be as follows:

$0.254 - 0.195 = 0.059$N (no sheet condition);

$0.239 - 0.180 = 0.059$N (sheet full load condition).

Thus, it is apparent that the urging force is not varied between the no sheet condition and the sheet full load condition.

Incidentally, the above calculations can also be adopted to the torsion coil spring 43 shown in FIG. 2A, and the spring constant of the coil spring 43 can be selected similarly.

Next, a second embodiment of the present invention will now be explained.

Figure 3:
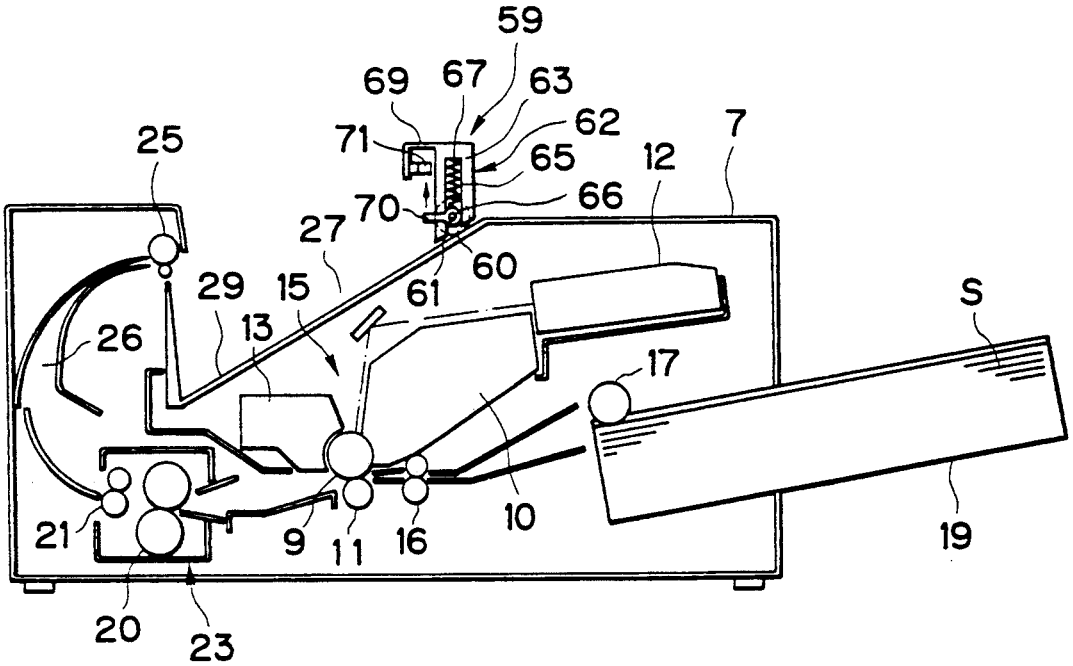
FIG. 3 is an elevational sectional view of an image forming system (laser beam printer) according to another embodiment of the present invention.
Figure 4:
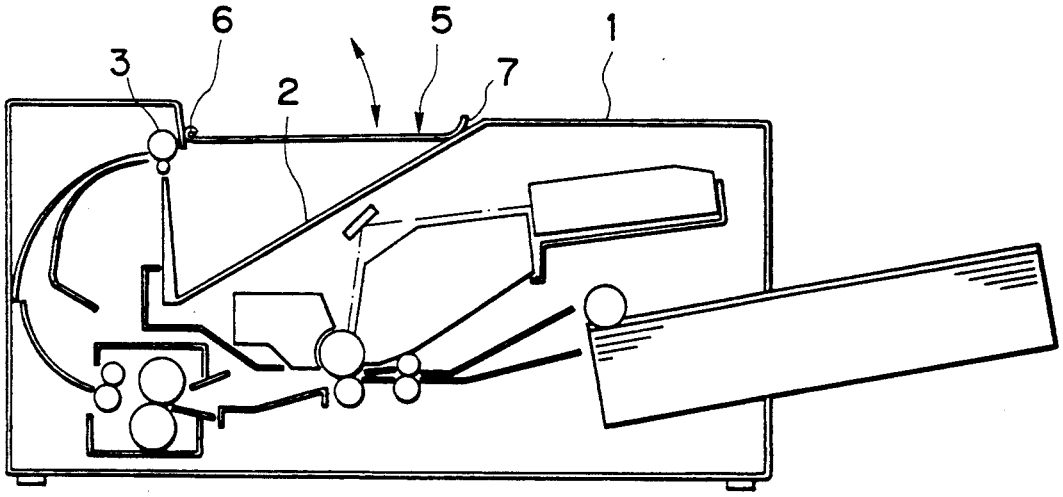
FIG. 4 PRIOR ART
FIG. 4 is an elevational sectional view a conventional sheet hold-down member arranged at a sheet ejection tray portion of an image forming system.

FIG. 3 generally shows an image forming system (laser beam printer) according to the second embodiment of the present invention.

The image forming system according to this second embodiment is the same as that of the first embodiment, except for the construction of a sheet hold-down device 59; accordingly, only the sheet hold-down device 59 will be described hereinafter.

The sheet hold-down device 59 comprises a sheet hold-down roller 60, and a roller supporting member 61 for rotatably supporting roller shafts 61 (only one of which is shown) formed on both ends of the sheet hold-down roller 60 laterally outside of sheets collected on the sheet ejection tray 27 and for guiding the sheet hold-down roller 60 for up-and-down movement with respect to a surface of the tray within a predetermined range.

The roller supporting member 61 is of arch configuration as a side view, and vertical guide grooves 65 are formed in both side supporting portions 63 of the sheet supporting member. The roller shafts 61 are received in the respective guide grooves 65 via respective bearings 66. The roller supporting member 62 mounting the sheet hold-down roller in this way is removably attached to the body frame 7 in a vertical orientation above the inclined surface 29 of the tray.

The sheet hold-down roller 60 mounted on the roller supporting member 62 is biased by coil springs 67 received in the guide grooves 65 so that the roller contacts the tray surface 29 with a predetermined urging force. As the sheets collected on the ejection tray 27 are increased, the sheet hold-down roller 60 is moved upwardly along the guide grooves 65. Incidentally, if the predetermined urging force is obtained only by the weight of the roller itself, the coil springs 67 can be omitted.

A sensor attachment portion 69 is integrally formed on one of the supporting portions 63 of the roller supporting member 62, and a roller detection sensor 71 is attached to the sensor attachment portion 69, which sensor serves to output a detection signal when it detects a horizontal projection 70 integrally formed on one of the bearings 66. In this case, when the sheet hold-down roller 60 is moved upwardly up to a sheet full load position, the projection 70 is detected by the roller detection sensor 71.

In this embodiment, the sheet hold-down roller 60, roller supporting member 62 and bearings are made of molded material, respectively.

In the sheet hold-down device 59 according to the second embodiment, since the sheet hold-down roller 60 can be moved in the up-and-down direction with respect to the tray surface 29, the urging force of the roller does not change at any positions of the roller.

Further, since the sheet hold-down device is constituted as a rigid construction by the sheet hold-down roller 60 and the roller supporting member 62, even when the sheet hold-down device is dismounted from or mounted on the body frame 7, it is not deformed or damaged. Further, since the sheet full load condition is detected by the roller detection sensor 71, the sheets are prevented from dropping on a floor or from being jammed in the vicinity of the ejector roller pair 25.

Since the sheet hold-down device 59 according to the second embodiment can be incorporated into the roller supporting member 62, it can be used as option.

As mentioned above, the image forming system according to the present invention is provided with a sheet hold-down device comprising a sheet hold-down member pivotally mounted, as its base end, on a sheet ejection tray via a support shaft for pivotal movement in a direction perpendicular to a surface of the tray, and a hold-down member biasing means for biasing the sheet hold-down member away from the surface of the tray in opposition to a weight of the sheet hold-down member and for maintaining a predetermined urging force of the sheet hold-down member so long as the sheet hold-down member is within a predetermined range of its pivotal movement, whereby the sheet is held by maintaining the balance between the weight of the sheet hold-down member itself and a spring force of the biasing means to substantially a given range.

Further, the present invention may be provided with a sheet-hold down device comprising a sheet hold-down roller disposed on a sheet ejection tray, and a roller supporting member for rotatably supporting roller shafts formed on both ends of the sheet hold-down roller laterally outside of sheets collected on the sheet ejection tray and for guiding the sheet hold-down roller for up-and-down movement with respect to a surface of the tray within a predetermined range.

I claim:

1. An image forming system comprising:

a sheet ejection open tray on which ejected sheets can be collected, said tray being inclined so that an ejection side thereof is lower than a non-ejection side; and a sheet hold-down device including a sheet hold-down member pivotally mounted, at its base end, on the ejection side of said sheet ejection open tray via a support shaft for pivotal movement in a direction perpendicular to a surface of said sheet ejection open tray within a range between a substantially horizontal state and an inclined state where a pivoted end is located lower than the other end, and biasing means for biasing said sheet hold-down member so that the other end is urged away from the surface of said sheet ejection open tray in opposition to the weight of said sheet hold-down member itself and for maintaining a predetermined urging force on said sheet hold-down member so long as said sheet hold-down member is within a predetermined range of its pivotal movement.

2. An image forming system according to claim 1, wherein said hold-down member biasing means comprises spring means generating an elastic force which becomes smaller as said sheet hold-down member is pivoted away from the surface of said sheet ejection tray.

3. An image forming system according to claim 2, wherein said sheet hold-down member is set as it is pivoted away from the surface of said sheet ejection open tray, so that the force on said sheet hold-down member toward the surface of said sheet ejection tray decreases.

4. An image forming apparatus according to claim 3, wherein, when the mass of said sheet hold-down member toward the surface of said sheet ejection tray in a horizontal position of said sheet hold-down member is $m_1$, the return elastic force of said spring means at that time is $P_1$, the mass of said sheet hold-down member toward the surface of said sheet ejection tray in a certain pivot angle of said sheet hold-down member is $m_2$, the gravity is G, and the return elastic force of said spring means at that time is $P_2$, the sheet urging forces are defined by $(m_1 \times G - P_1)$, $(m_2 \times G - P_2)$, respectively, and said spring means is selected so that a relation $(m_1 \times G - P_1) = (m_2 \times G - P_2)$ is obtained.

5. An image forming system comprising:

a sheet ejection open tray on which ejected sheets can be collected, said tray being inclined so that an ejection side thereof is lower than a non-ejection side; and a sheet hold-down device including a sheet hold-down roller, and a roller supporting member for rotatably supporting roller shafts formed on both ends of said sheet hold-down roller laterally outside of the sheets collected on said sheet ejection open tray and for guiding said sheet hold-down roller for up-and-down movement with respect to a surface of said sheet ejection open tray within a predetermined range, wherein said roller supporting member is pivotally mounted at its base end, on the ejection side of said sheet ejection open tray via a support shaft for pivotal movement in a direction perpendicular to a surface of said sheet ejection open tray, within a range between a substantially horizontal state and an inclined state where a pivoted end is located lower than the other end, and wherein said sheet hold-down device further comprises roller supporting member biasing means for biasing said roller supporting member away from the surface of said sheet ejection open tray in opposition to the weight of said roller supporting member itself and for maintaining a predetermined urging force on said roller supporting member so long as said roller supporting member is within a predetermined range of its pivotal movement.

6. An image forming system according to claim 5, further including a detection means for detecting the bringing of said sheet hold-down roller into a sheet full load position.

7. An image forming system according to claim 1, further including a detection means for detecting the bringing of said sheet hold-down member into a sheet full load position.

8. An image forming system according to claim 4, wherein said spring means comprises a torsion coil spring, and further including means for adjusting a torsion force of said torsion coil spring.

* * * * *

UNITED STATES PATENT AND TRADEMARK OFFICE

CERTIFICATE OF CORRECTION

PATENT NO. : 5,260,759
DATED : November 9, 1993
INVENTOR(S) : HIROO KOBAYASHI

It is certified that error appears in the above-identified patent and that said Letters Patent is hereby corrected as shown below:

On The Title Page

FAPD, insert: --[30] Foreign Application Priority Data July 31, 1990 [JP] Japan.....2-203324--.

COLUMN 5
Line 16, "anti-clockwise" should read --counter-clockwise--.

COLUMN 6
Line 52, "has" should read --have--.

COLUMN 8
Line 60, "option." should read --an option.--.

COLUMN 9
Line 45, "tray." should read --open tray.--;
Line 50, "tray" should read --open tray--; and
Line 54, "tray" should read --open tray--.

COLUMN 10
Line 4, "tray" should read --open tray--.

Signed and Sealed this

Twenty-first Day of June, 1994

Bruce Lehman

BRUCE LEHMAN

*Attest:*

*Attesting Officer*

*Commissioner of Patents and Trademarks*